US006373359B1

(12) United States Patent
Chonan

(10) Patent No.: US 6,373,359 B1
(45) Date of Patent: Apr. 16, 2002

(54) DEFLECTION YOKE APPARATUS

(75) Inventor: Yusuke Chonan, Iwai (JP)

(73) Assignee: Victor Company of Japan, Ltd., Kanagawa-ken (JP)

( * ) Notice: Subject to any disclaimer, the term of this patent is extended or adjusted under 35 U.S.C. 154(b) by 0 days.

(21) Appl. No.: 09/666,214

(22) Filed: Sep. 21, 2000

(30) Foreign Application Priority Data

Sep. 22, 1999 (JP) ..... 11-268280

(51) Int. Cl.[7] ..... H01J 29/76
(52) U.S. Cl. ..... 335/210; 211/212
(58) Field of Search ..... 335/210–214; 313/440; 315/8

(56) References Cited

U.S. PATENT DOCUMENTS 5,192,935 A * 3/1993 Yun ..... 335/211

FOREIGN PATENT DOCUMENTS

JP 11-339688/1999 12/1999

* cited by examiner

*Primary Examiner*—Ramon M. Barrera
(74) *Attorney, Agent, or Firm*—Anderson Kill & Olick; Eugene Lieberstein; Michael Meller

(57) ABSTRACT

The container section 18 comprises the contacting section (first contacting section) **18*e*1 of contacting with the top surface of the magnet 19, the stopper section (second contacting section) 18*d*1 of contacting with the tip of the top end of the magnet 19 and the first tongue 18*c* having flexibility, which contacts with the edge composed of the top end and the bottom surface of the magnet 19 and presses the magnet 19 to both the stopper section 18*d*1 and the contacting section 18*e*1. The projection 18*f* provided on the tip of the tongue 18*c* engages with the notch 19*a* provided on the magnet 19, so that the magnet 19** is allocated in the lateral direction.

3 Claims, 7 Drawing Sheets

DEFLECTION YOKE APPARATUS

BACKGROUND OF THE INVENTION

1. Field of the Invention:

The present invention relates to a deflection yoke apparatus, which is improved in a construction of a container section for containing a component part for compensating a magnetic field characteristic such as a piece of magnet utilized for compensating a magnetic field characteristic such as misconvergence, for example.

2. Description of the Related Art:

FIG. 9 is a perspective view of the deflection yoke apparatus as one example of the prior art.

In FIG. 9, the deflection yoke apparatus is formed a funnel having a lager diameter section at the bottom end and a smaller diameter section at the top end supported by the separator 1, which is composed of a pair of semi-annular members. In addition thereto, the larger diameter section is toward a face of a cathode-ray tube and the smaller diameter section toward a neck of the cathode-ray tube.

A saddle shaped horizontal deflection coil, not shown, is mounted on the inner wall of the separator 1. The separator 1 holds the horizontal deflection coil and the vertical deflection coil 3 with electrically insulating them each other. The core 4 composed of such a component as ferrite is mounted on the outer surface of the vertical deflection coil 3. Generally, a circuit for compensating a deflection characteristic is necessary to such the deflection yoke apparatus mentioned above, so that the circuit board 5 composed of such the circuit is mounted on the side wall of the separator 1.

In the neck side of the separator 1, a plurality of flanges, hereinafter called a neck side flange 1*a* is provided. On the other hand, the flange, hereinafter called a face side flange 1*b* is provided in the face side of the separator 1. On the neck side flange 1*a*, a pair of 4 pole compensating coils 7, which are so called a 4P coil, are inserted and fixed.

Further, on the outer circumference area of the face side flange 1*b*, there provided 4 container sections 8, 2 each on the front side and back side of the face side flange 1*b* as shown in FIG. 9, which contain a component part for compensating a magnetic field characteristic such as a piece of magnet utilized for compensating a magnetic field characteristic. Such a board like magnet 9, not shown in FIG. 9 but shown in FIGS. 10(*a*) through 11(*c*), is contained in each container section 8. These 4 container sections 8 or 4 magnets 9 are allocated so as to be symmetric with the horizontal and vertical axes of a screen.

The magnet 9 contained in the container section 8 is allocated in a vicinity of a tangent to the outer circumference area of the face side flange 1*b*, and compensates horizontal cross misconvergence and vertical cross misconvergence occurs at 4 corners of the screen by canceling or shifting a distribution of deflection magnetic field generated by the vertical deflection coil 3 locally. Usually, the magnet 9 is made from sintered ferrite or rubber-like resin dispersed and mixed with powdered ferrite.

FIG. 10(*a*) is a perspective view of the container section on the face side flange shown in FIG. 9 partly, showing no magnet mounted.

FIG. 10(*b*) is a perspective view of the container section on the face side flange shown in FIG. 9 partly, showing a magnet mounted.

FIGS. 11(*a*) through 11(*c*) are sectional views taken substantially along line a—a of FIG. 10(*a*), showing a change of status while installing a magnet in the container section.

In FIGS. 10(*a*) and 10(*b*), the right side of the drawing is the upper side or the neck side of the deflection yoke apparatus shown in FIG. 9 and the left side of the drawing is the lower side or the face side of the deflection yoke apparatus shown in FIG. 9. Further, in FIGS. 11(*a*) through 11(*c*), the right side of the drawing is the inner side of the separator 1 and the left side of the drawing is the outer side of the separator 1. Furthermore, the line "H" is the horizontal axis of the deflection yoke apparatus or the screen.

As shown in FIGS. 10(*a*) and 10(*b*), there provide the first opening section 8*a* in a rectangular shape and the second opening section 8*b*, which is narrower and longer in shape than the first opening section 8*a* and jointed to the first opening section 8*a*, on the outer circumference area of the face side flange 1*b*.

As shown in FIGS. 11(*a*) through 11(*c*), the tongue 8*c*, which is jointed to one end of the first opening section 8*a* opposite to the second opening section 8*b* and comes into the inside of the separator 1, is formed on the outer circumference area of the face side flange 1*b*. The tongue 8*c* has flexibility, so that it can bend toward the arrow direction shown in FIG. 11(*a*). Further, the stopper section 8*d*, which is shaped as the letter "L" and comes into the inside of the separator 1, is formed on the other end opposite to the first opening section 8*a* in the second opening section 8*b* in the outer circumference area of the face side flange 1*b*. Furthermore, the claw 8*e* protruding to the inside of the separator 1 is formed on the inside surface of both ends of the second opening section 8*b* connected to the first opening section 8*a* in the outer circumference area of the face side flange 1*b*.

The container section 8 is formed as a pocket by the first opening section 8*a*, the second opening section 8*b*, the tongue 8*c*, the stopper section 8*d* and the claw 8*e*. In the case that the board like magnet 9 is installed into the pocket like container section 8 formed as mentioned above, the magnet 9 is inserted into the container section 8 through the first opening section 8*a* as shown in FIG. 11(*a*). As shown in FIG. 11(*b*), the tongue 8*c* is bent toward the inside of the face side flange 1*b* when the magnet 9 touches the tongue 8*c* while being pushed in the container section 8. As shown in FIG. 11(*c*), when the magnet 9 is inserted as far as the stopper section 8*d*, the top end of the magnet 9 approximately touches with the stopper section 8*d* and the bottom end of the magnet 9 approximately touches with the tip of the claw 8*e*. Accordingly, the magnet 9 is held in the space between the stopper section 8*d* and the claw 8*e* in the container section 8.

In the case that the magnet 9 is made from sintered ferrite, ferrite shrinks extremely during a sintering process, so that the external dimension of a magnet varies widely after sintered. Further, in the case that the magnet 9 is made from rubber-like resin dispersed and mixed with powdered ferrite, the outer dimension of a magnet varies widely due to an injection process and a cutting process. Therefore, the dimension of the magnet 9 varies such that an error or a fluctuation of dimension is approximately ±2%, that is, an error of ±0.2 mm occurs to the reference length of 10 mm in general.

Accordingly, in the deflection yoke apparatus containing the magnet 9 in the container section 8 as mentioned above, it is necessary for the dimension of the container section 8 to be more enlarged than the reference dimension of the magnet 9 in consideration of variation of the external dimension of the magnet 9. In the case that the reference length of the magnet 9 is 10 mm, for example, the actual length of the container section 8 must be formed more than 10.2 mm. If the magnet 9 formed in the minimum dimension is inserted into the container section 8 mentioned above, an extra space of 0.4 mm occurs between the magnet 9 and the container section 8 and causes the magnet 9 to rattle.

Allocation of the magnet 9 contained in the container section 8 differs from variations of the external dimension of the magnet 9. Accordingly, there existed the problem that the convergence characteristic varies by the external dimension of the magnet 9. Further, there existed another problem that the initial convergence characteristic is shifted due to the dislocation of the magnet 9 by such a shock applied externally after the magnet 9 is contained. To eliminate these problems, the magnet 9 is fixed by an adhesive after the magnet 9 is contained in the container section 8. However, there existed further problem such that the adhesive increases a manufacturing cost and manpower for a process of applying the adhesive.

SUMMARY OF THE INVENTION

Accordingly, in consideration of the above-mentioned problem of the prior art, an object of the present invention is to provide a deflection yoke apparatus, which is equipped with a container section for containing a component part for compensating a magnetic field characteristic. In the deflection yoke apparatus, the component part can be allocated approximately in a predetermined location and its location is not accidentally shifted although an external dimension of the component part varies.

In order to achieve the above object, the present invention provides a deflection yoke apparatus equipped with a container section of containing a component part for compensating a magnetic field characteristic, the container section comprising: a first contacting section of contacting with a surface of the component part; a second contacting section of contacting with a front end of the component part of which direction is toward an inserting direction into the container section; and a tongue having flexibility of contacting with a edge, which is composed of a rear end of the component part toward the inserting direction into the container section and a bottom surface of the component part, and further presses the component part against both the first and second contacting sections.

Other object and further features of the present invention will be apparent from the following detailed description when read in conjunction with the accompanying drawings.

BRIEF DESCRIPTION OF DRAWINGS

FIG. 10(*b*) is a perspective view of the container section on the face side flange of FIG. 9 partly, showing a magnet mounted.

DETAILED DESCRIPTION OF THE PREFERRED EMBODIMENTS

First Embodiment

Figure 1:
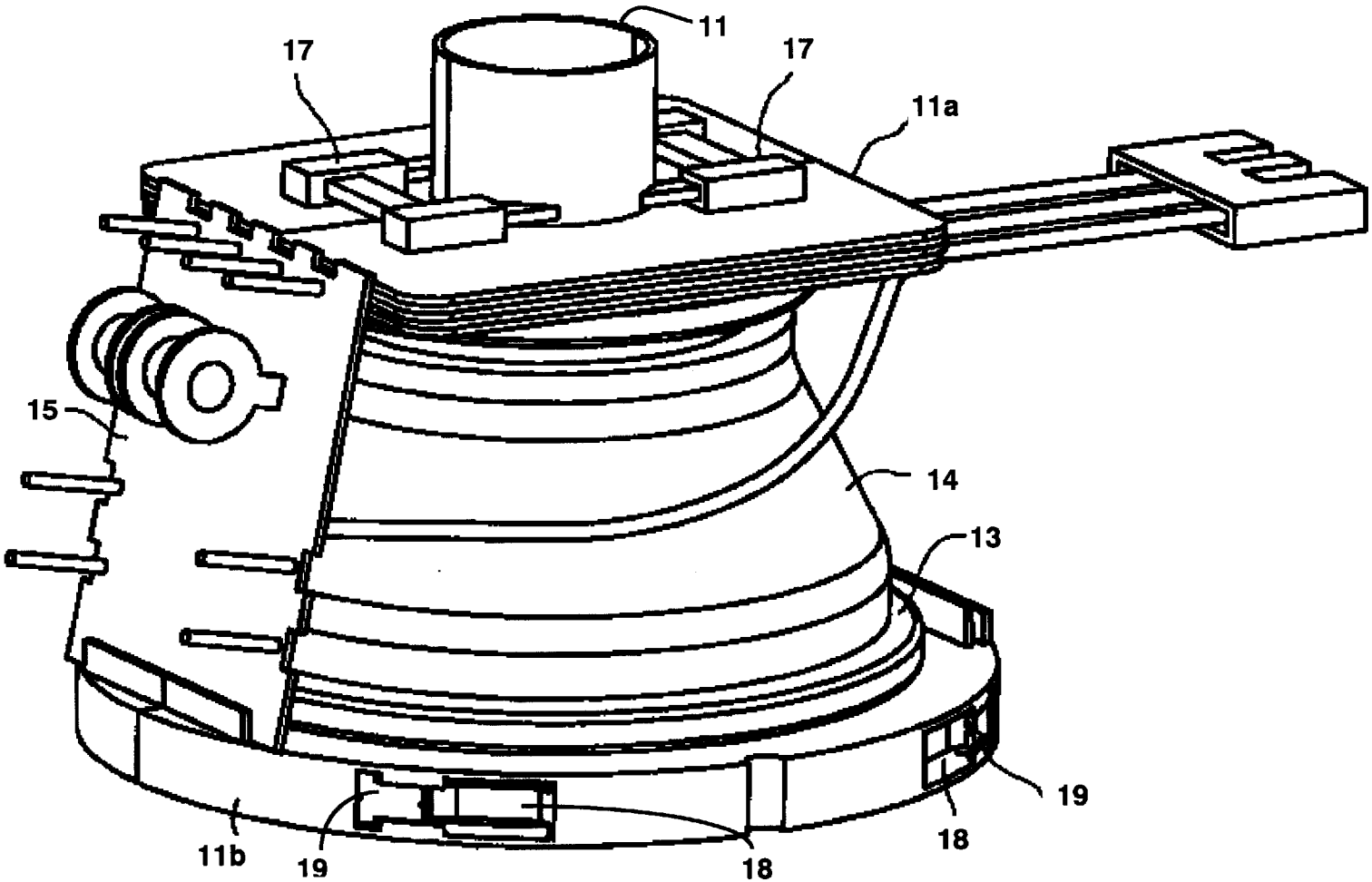
FIG. 1 is a perspective view of a total construction of a deflection yoke apparatus according to a first embodiment of the present invention.

FIG. 1 is a perspective view of a total construction of a deflection yoke apparatus according to a first embodiment of the present invention.

In FIG. 1, a deflection yoke apparatus is formed a funnel having a lager diameter section at the bottom end and a smaller diameter section at the top end supported by a separator 11, which is composed of a pair of semi-annular members. In addition thereto, the larger diameter section is toward a face of a cathode-ray tube and the smaller diameter section toward a neck of the cathode-ray tube. The separator 11 is made from plastic resin.

A saddle shaped horizontal deflection coil, not shown, is mounted on an inner wall of the separator 11. The separator 11 holds the horizontal deflection coil and a vertical deflection coil 13 with electrically insulating them each other. A core 14 composed of such a component as ferrite is mounted on an outer surface of the vertical deflection coil 13. Generally, a circuit for compensating a deflection characteristic is necessary to such the deflection yoke apparatus mentioned above, so that a circuit board 15 composed of such the circuit is installed on the side wall of the separator 11.

In the neck side of the separator 11, a plurality of flanges, hereinafter called a neck side flange 11*a* is provided. On the other hand, the flange, hereinafter called a face side flange 11*b* is provided in the face side of the separator 11. On the neck side flange 11*a*, a pair of 4 pole compensating coils 17, which are so called a 4P coil, are inserted and fixed.

Further, on the outer circumference area of the face side flange 11*b*, there provided 4 container sections 18, 2 each on the front side and back side of the face side flange 11*b* as shown in FIG. 1, which contain a component part for compensating a magnetic field characteristic such as a piece of magnet utilized for compensating a magnetic field characteristic. Such a board like magnet 19 is contained in each container section 18. These 4 container sections 18 or 4 magnets 19 are allocated so as to be symmetric with the horizontal and vertical axes of a screen.

The magnet 19 contained in the container section 18 is allocated in a vicinity of a tangent to the outer circumference area of the face side flange 11*b*, and compensates horizontal cross misconvergence and vertical cross misconvergence occur at 4 corners of the screen by canceling or shifting a distribution of deflection magnetic field generated by the vertical deflection coil 13 locally.

Figure 2:
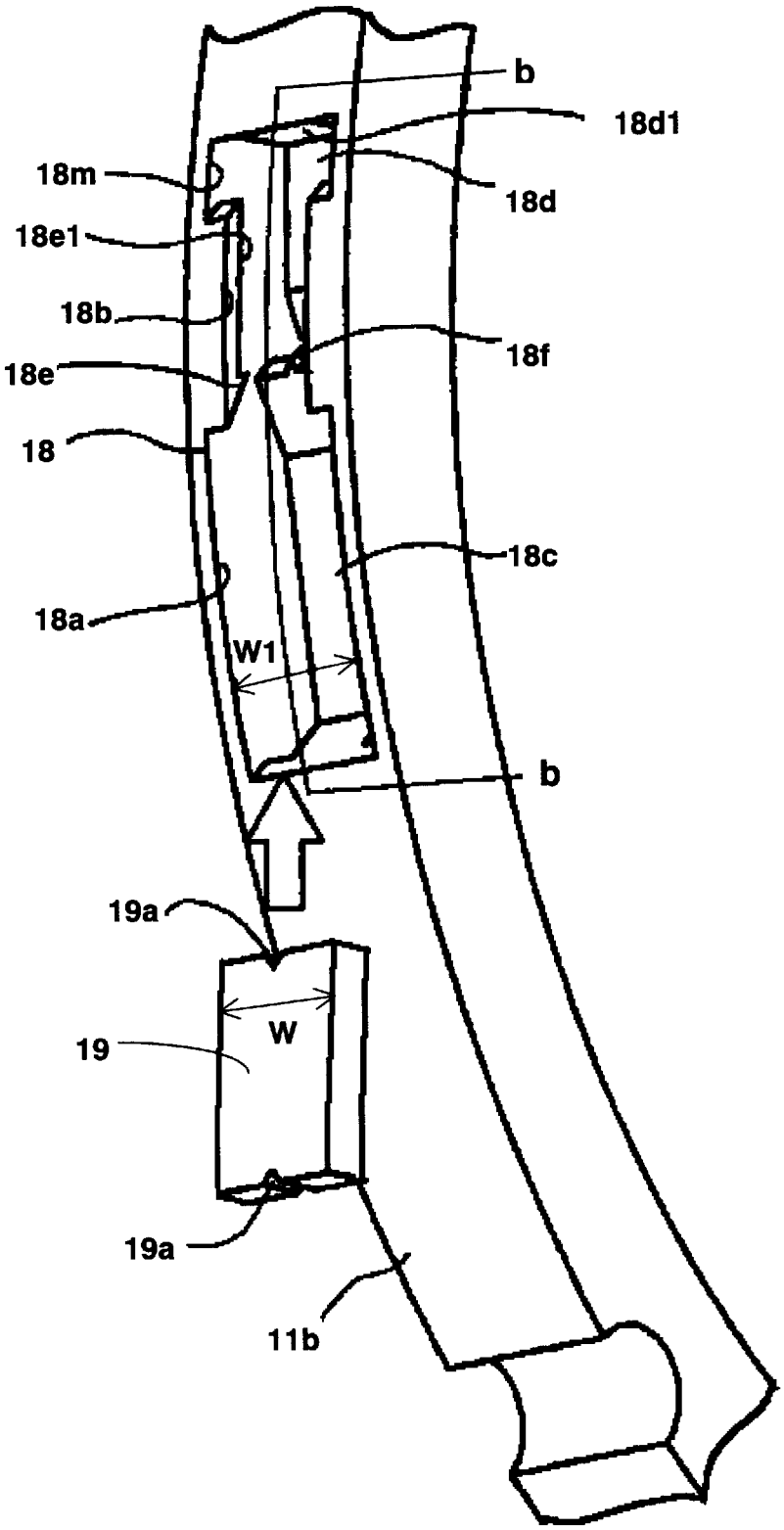
FIG. 2 is a perspective view of a part of the deflection yoke apparatus shown in FIG. 1 according to the first embodiment of the present invention.

FIG. 2 is a perspective view of a part of the deflection yoke apparatus shown in FIG. 1 showing a preceding state of the magnet 19 being inserted into the container section 18 according to the first embodiment of the present invention.

Figure 3:
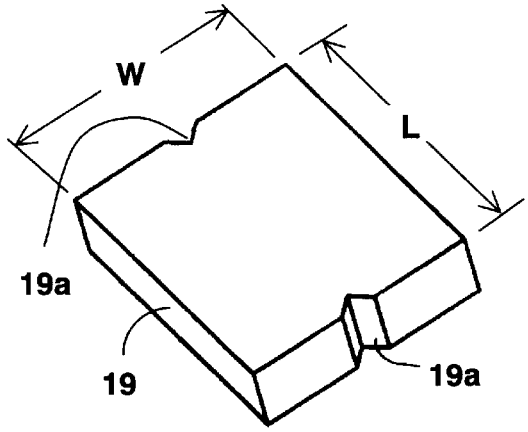
FIG. 3 is a perspective view of a component part for compensating a magnetic field characteristic as one example according to the first embodiment of the present invention.

FIG. 3 is a perspective view of the magnet 19 for compensating a magnetic field characteristic according to the first embodiment of the present invention.

Figure 4:
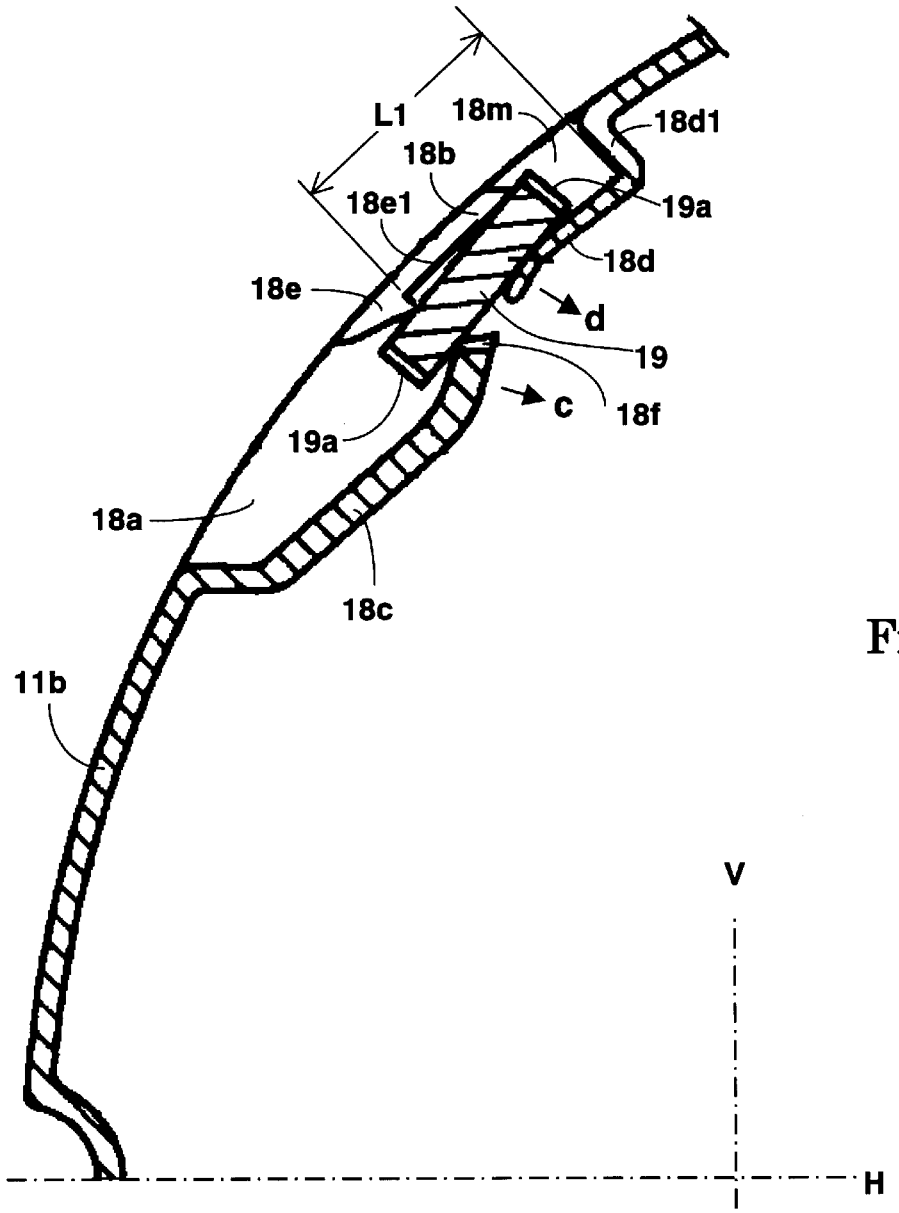
FIG. 4 is a cross sectional view of the deflection yoke apparatus taken substantially along line a—a of FIG. 2.

FIG. 4 is a cross sectional view of the deflection yoke apparatus taken substantially along line a—a of FIG. 2 showing an intermediate state of the magnet 19 being inserted into the container section 18.

Figure 5:
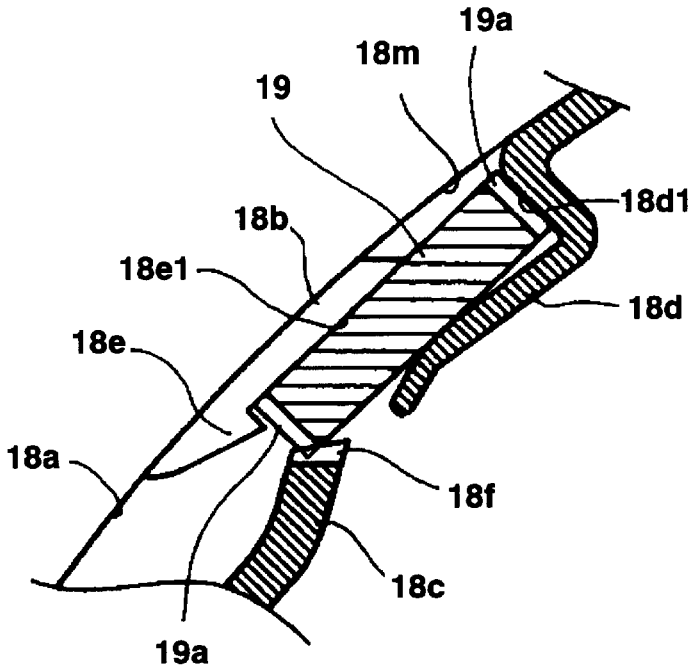
FIG. 5 is a fragmentary cross sectional view of the deflection yoke apparatus with partially enlarging FIG. 4.

FIG. 5 is a fragmentary cross sectional view of the deflection yoke apparatus taken substantially along line a—a of FIG. 2 showing a final state of the magnet 19 being installed in the container section 18 completely.

In FIG. 2, a right side direction is toward the neck side or the upper end of the deflection yoke apparatus shown in FIG. 1 and a left side direction is toward the face side or the bottom end of the deflection yoke apparatus shown in FIG. 1.

In FIGS. 4 and 5, a right side direction is toward the inside of the separator 11 and a left side direction is toward the outside of the separator 11. Letters "H" and "V" shown in FIG. 4 are a horizontal axis and a vertical axis of the deflection yoke apparatus or a screen respectively.

As shown in FIG. 2, a rectangular shaped first opening section 18*a*, a second opening section 18*b* having a narrower width than the first opening section 18*a* and being jointed to the first opening section 18*a* and a third opening section 18*m* having approximately a same width as that of the first opening section 18*a* and being jointed to the second opening section 18*b* are formed in an outer circumference area of the face side flange 11*b*. A width "W1" of the first and third opening sections 18*a* and 18*m* is assigned to be more than a maximum value of scattering of a width "W" of the magnet 19 shown in FIGS. 2 and 3. A width of the second opening section 18*b* is narrower than the width "W" of the magnet 19. As shown in FIG. 3, the magnet 19 is formed like a board having a width "W" and a length "L" and provided with two notches 19*a* at both ends.

With referring to FIGS. 2 and 4, a first tongue 18*c*, which is jointed to one end of the first opening section 18*a* opposite to the second opening section 18*b* and comes into the inside of the separator 11, is formed on the outer circumference area of the face side flange 11*b*. The first tongue 18*c* has flexibility, so that it can bend toward the arrow direction "c". Further, a second tongue 18*d*, which is shaped as the letter "L" and comes into the inside of the separator 11, is formed on the other end opposite to the first opening section 18*a* in the third opening section 18*m* in the outer circumference area of the face side flange 11*b*. Furthermore, a claw 18*e* protruding to the inside of the separator 11 is formed on the inside surface of both ends of the second opening section 18*b* connected to the first opening section 18*a* in the outer circumference area of the face side flange 11*b*. The second tongue 18*d* also has flexibility, so that it can bend toward the arrow direction "d". A stopper section (second contacting section) 18*d*1 is provided at a bottom end of the second tongue 18*d*, wherein a tip of the magnet 19 hits against the stopper section 18*d*1.

The claw 18*e* protruding to the inside of the separator 11 is formed on the inside surface of both ends of the second opening section 18*b* connected to the first opening section 18*a* in the outer circumference area of the face side flange 11*b*. A contacting section (first contacting section) 18*e*1, which contacts with the top surface of the magnet 19, is provided on an inner surface of the separator 11 along both sides of the second opening section 18*b* in the circumferential direction. Further, a tip of the first tongue 18*c* is slightly bent to the outside of the separator 11 as shown in FIG. 4. A projection 18*f* is formed on the tip of the first tongue 18*c* with approximately facing toward the claw 18*e*. A distance L1 between the claw 18*e* and the stopper section 18*d*1 is assigned to be more than a maximum value of scattering of a length "L" of the magnet 19 shown in FIG. 3.

According to the first embodiment mentioned above, the pocket like container section 18 is formed by the first opening section 18*a*, the second opening section 18*b*, the third opening section 18*m*, the first tongue 18*c*, the second tongue 18*d* including the stopper section 18*d*1, the claw 18*e*, the contacting section 18*e*1 and the projection 18*f*.

On the other hand, the magnet 19 is made from sintered ferrite, for example, and formed a parallelpipedic board as shown in FIG. 3. Two notches 19*a* having a shape of triangular are engraved on both front and rear ends of the magnet 19 toward an inserting direction into the container section 18. In FIG. 3, the notch 19*a* is provided approximately at the center of the width "W" of the magnet 19. However, a location of the notch 19*a* is not limited to the center. Further, it is desirable for the magnet 19 to provide two notches 19*a* on both ends. However, either one of notches 19*a* can be eliminated.

In a case that the board shaped magnet 19 is inserted into the container section 18, the magnet 19 is inserted into the container section 18 through the first opening section 18*a* as shown in FIG. 2. When the magnet 19 is pressed against the first tongue 18*c*, the first tongue 18*c* bends inward direction "c" as shown in FIG. 4. When the magnet 19 is thrust in as far as the second tongue 18*d*, the second tongue 18*d* also bends inward direction "d" and the top surface of the magnet 19 is pressed against the contacting section 18*e*1 by a repulsion power of the second tongue 18*d*. A tip of a lower end of the magnet 19 clears the claw 18*e* immediately before an upper end of the magnet 19 contacts with the contacting section 18*d*1.

While the tip of the lower end of the magnet 19 clears the claw 18*e*, the projection 18*f* formed on the tip of the first tongue 18*c* engages with the notch 19*a* of the magnet 19 as shown in FIG. 5. The tip of the first tongue 18*c* is totally slanted to an end surface of the magnet 19, so that the projection 18*f* is also slanted to the end surface of the magnet 19. Accordingly, the first tongue 18*c* and the projection 18*f* contact with a lower under edge of the magnet 19 and supply a pressing force to the magnet 19. Since the first tongue 18*c* presses the edge of the magnet 19, an upper tip of the magnet 19 is pressed against the stopper section 18*d*1 and the top surface of the magnet 19 is pressed against the contacting section 18*e*1. The claw 18*e* is provided so as to prevent the magnet 19 from accidental falling off even though a pressing force by the first tongue 18*c* is weaken or the first tongue 18*c* is broken by some reason.

As mentioned above, a location of the magnet 19 is limited by 4 directions, both ends in the thrust direction and top and bottom surfaces. Therefore, the magnet 19 is contained and held in the container section 18 without rattling although a dimension of the magnet 19 is scattered. Further, the projection 18*f* engages with the notch 19*a* of the magnet 19, so that a location of the magnet 19 in lateral direction is also limited by the projection 18*f*. Accordingly, the magnet 19 is approximately allocated in a predetermined area, so that a scattering of the convergence characteristic hardly occurs. In addition thereto, the magnet 19 can not be accidentally dislocated, so that it is not necessary for the magnet 19 to be fixed with adhesive.

Figure 6:
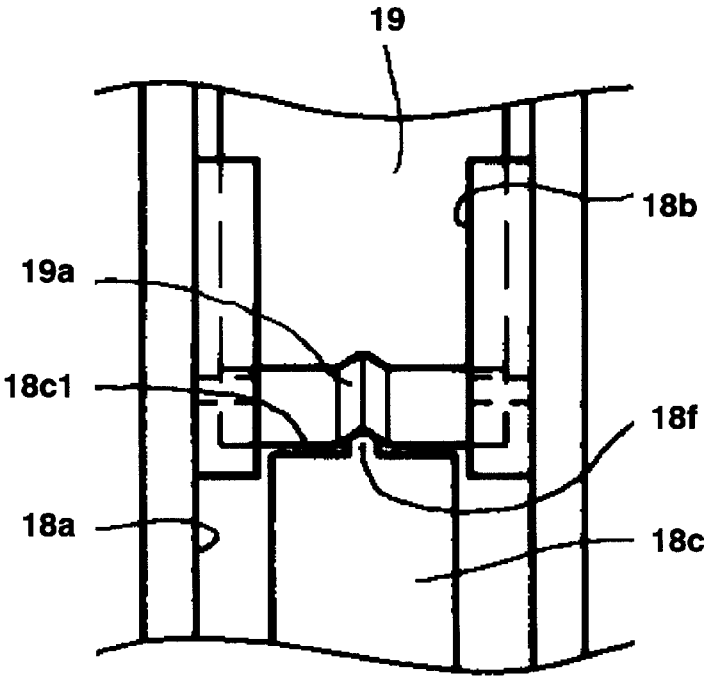
FIG. 6 is a fragmentary plan view of the deflection yoke apparatus partially enlarged according to the present invention.

FIG. 6 is a fragmentary plan view of the container section 18 containing the magnet 19, viewing from the outside of the separator 11 according to the present invention. In some cases such as relations of shape and size between the projection 18*f* provided on the tip of the first tongue 18*c* and the notch 19*a* of the magnet 19, the projection 18*f* may only contact with the magnet 19 and a top end surface 18*c*1 of the first tongue 18*c* excluding the projection 18*f* may not contact with the magnet 19 at all as shown in FIG. 6. In this case, the projection 18*f* functions such that the projection 18*f* limits a location of the magnet 19 in lateral direction and supplies a pressing force to the magnet 19.

Second Embodiment

Figure 7:
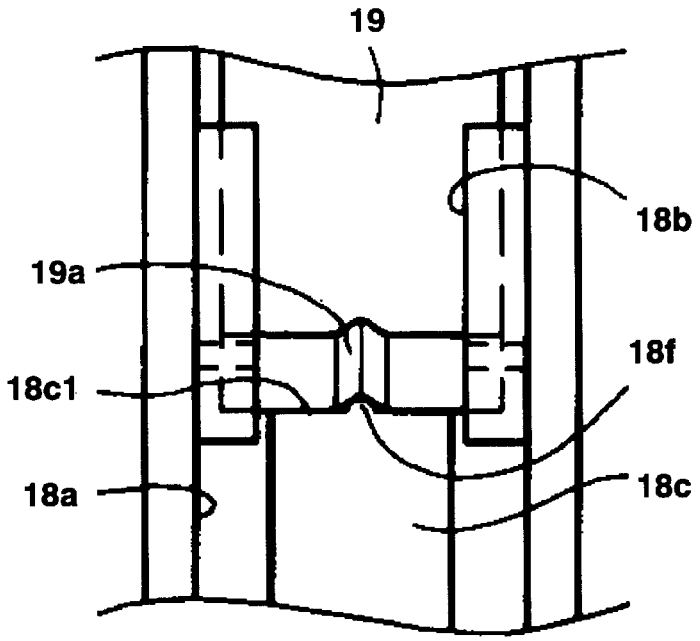
FIG. 7 is a fragmentary plan view of the deflection yoke apparatus partially enlarged according to a second embodiment of the present invention.

FIG. 7 is a fragmentary plan view of the container section 18 containing the magnet 19, viewing from the outside of the separator 11 according to a second embodiment of the present invention.

In some cases such as relations of shape and size between the projection 18*f* provided on the tip of the first tongue 18*c* and the notch 19*a* of the magnet 19, it can be realized that the projection 18*f* engages with the notch 19*a* completely. In this case, the top end surface 18*c*1 of the first tongue 18*c* excluding the projection 18*f* contacts with the magnet 19 as shown in FIG. 7. According to the construction mentioned above, the projection 18*f* limits a location of the magnet 19 in lateral direction and the top end surface 18*c*1 of the first tongue 18*c* excluding the projection 18*f* supplies a pressing force to the magnet 19.

Accordingly, a member, which contacts with the edge of the magnet 19 and pushes the magnet 19 to two directions toward the stopper section 18*d*1 and the contacting section 18*e*1, can be realized by the top end surface 18*c*1 of the first tongue 18*c* excluding the projection 18*f* as well as the projection 18*f*. In other words, the projection 18*f* is just required of an action as a location limiting means such that the projection 18*f* restricts the magnet 19 contained in the container section 18 in lateral direction of the magnet 19.

Third Embodiment

Figure 8:
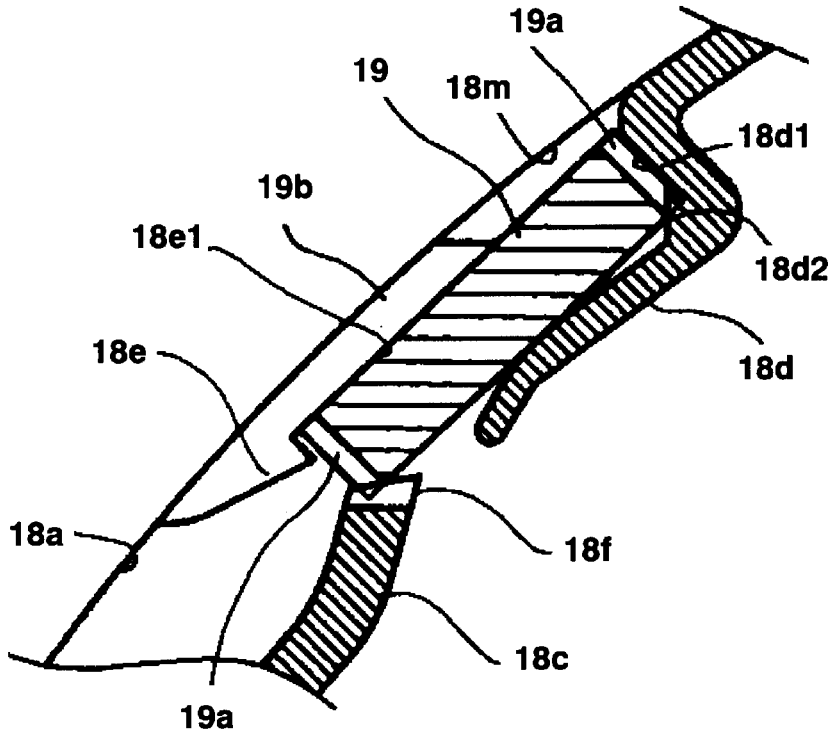
FIG. 8 is a fragmentary cross sectional view of the deflection yoke apparatus according to a third embodiment of the present invention.
Figure 9:
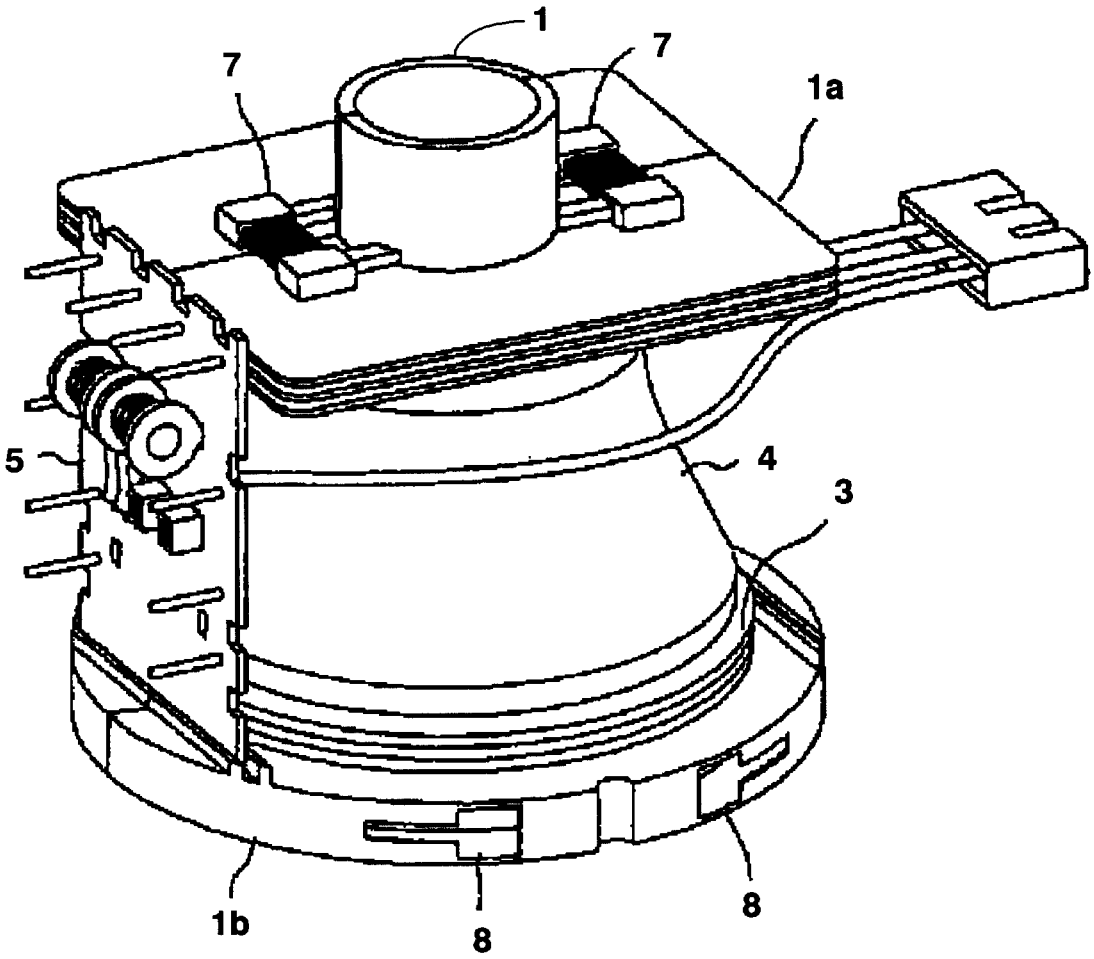
Fig. 9 Prior Art
FIG. 9 is a perspective view of the deflection yoke apparatus as one example of the prior art.
Figure 10A:
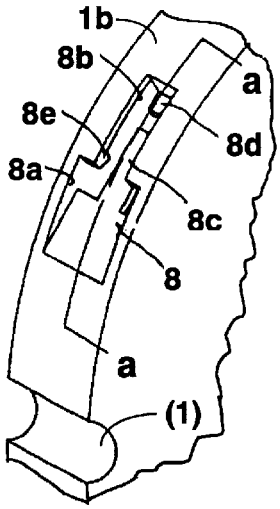
Fig. 10(a) Prior Art
FIG. 10(*a*) is a perspective view of the container section on the face side flange of FIG. 9 partly, showing no magnet mounted.
Figure 10B:
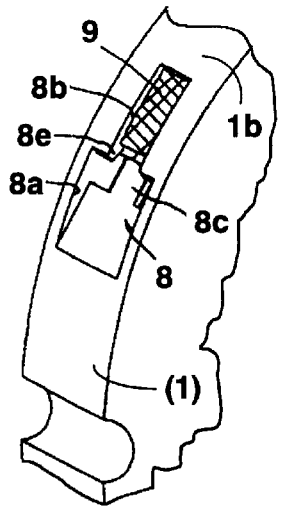
Fig. 10(b) Prior Art
Figure 11A:
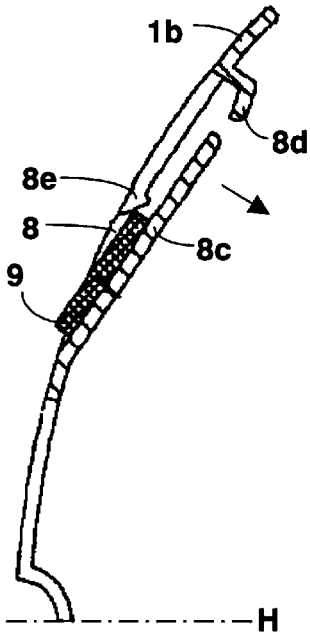
Fig. 11(a) Prior Art
FIGS. 11(*a*) through 11(*c*) are sectional views taken substantially along line a—a of FIG. 10(*a*), showing a change of status while installing a magnet in the container section.
Figure 11B:
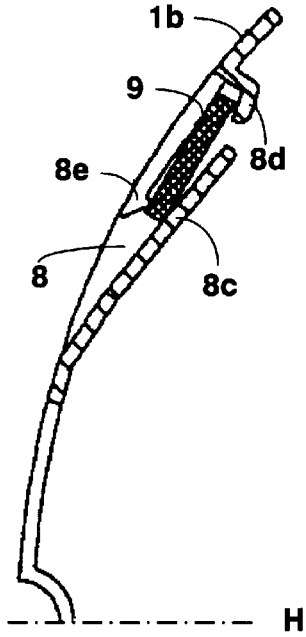
Fig. 11(b) Prior Art
Figure 11C:
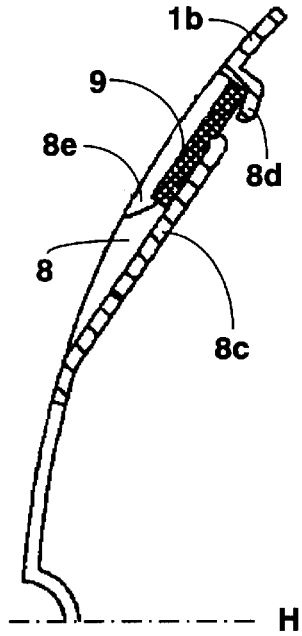
Fig. 11(c) Prior Art

FIG. 8 is a fragmentary cross sectional view of the deflection yoke apparatus taken substantially along line a—a of FIG. 2 showing a final state of the magnet 19 being installed in the container section 18 completely.

In FIG. 8, there provided a second projection 18*d*2 on the second tongue 18*d* so as for the second projection 18*d*2 to engage with the notch 19*a* allocated at the upper end of the magnet 19. The notch 19*a* is provided on both ends of the magnet 19 so as to be inserted into the container section 18 in either direction. In the first and second embodiments mentioned above, the notch 19*a* allocated at the upper end of the magnet 19 is not utilized for a location limiting means. However, in this embodiment, the notch 19*a* allocated at the upper end of the magnet 19 is utilized for a location limiting means.

As shown in FIG. 8, the second projection 18*d*2 contacts with an edge allocated at an upper lower end of the magnet 19, so that the second tongue 18*d* presses the lower end of the magnet 19 to the first tongue 18*c* and presses against the top surface of the magnet 19 to the contacting section 18*e*1. Accordingly, such a construction as limiting a location of the magnet 19 and adding pressure to the magnet 19 at both ends of the magnet 19 is effective for a magnet in relatively bigger dimension.

While the invention has been described above with reference to specific embodiment thereof, it is apparent that many changes, modifications and variations in the arrangement of equipment and devices and in materials can be made without departing from the invention concept disclosed herein. For example, the projection 18*f* can be formed into any shapes such as a semi-cylinder, a square pillar and a triangular pillar. Further, the projection 18*f* can be formed into any length. The shape of the notch 19*a* of the magnet 19 is not limited to a triangular. Any shape such as a semi-cylinder and a square pillar can be adopted. It can be acceptable that a projection is formed on the magnet 19 and a concave is formed on the tip of the first tongue 18*c*, although they are not shown in any drawings, and these projection and concave are engaged with each other. A quantity of the projection 18*f* or the concave on the first tongue 18*c* and the notch 19*a* or projection of the magnet 19 is not limited to one each. Any quantities can be applicable.

Furthermore, in the case of the third embodiment, it is acceptable that a projection is formed on the upper end of the magnet 19 and a concave is formed on the second tongue 18*d* instead of the second projection 18*d*2 and these projection and concave are engaged with each other. Moreover, a concave and a projection can be provided on either ends of the magnet 19 respectively and a projection and a concave can be provided on the first tongue 18*c* and the second tongue 18*c* respectively so as to engage with each other.

Each embodiment mentioned above depicts the deflection yoke apparatus of containing the magnet 19 in the container section 18. However, the construction of the container section 18 in accordance with the present invention can be utilized for containing not only the magnet 19 but also other component parts for compensating a magnetic field characteristic such as a piece of magnetic substance. Further, an external shape of the magnet 19 is not limited to the rectangular.

In the embodiments mentioned above, the external shape of the magnet 19 is the rectangular, so that a part of the magnet 19 contacting with the second projection 18*d*2 and applying pressure to the magnet 19 is called an edge. However, the edge is not limited to an orthogonal edge. A curved surface can also be applicable to the edge. Further, the edge is a boundary area formed by the top or bottom end surface and the bottom surface of the magnet 19. Accordingly, in a case of applying pressure to the magnet 19, all areas, which presses against the magnet 19 to a direction of inserting the magnet 19 or opposite direction and a direction toward the top surface of the magnet 19, are included in a category of a edge.

Furthermore, the container section 18 and a component part for compensating a magnetic field characteristic are not limited to be allocated in the outer circumference area of the face side flange 11*b*. The construction in accordance with the present invention can be applied to any deflection yoke apparatuses having a formation equivalent to the container section 18 on a resin component other than the separator 11. In addition thereto, FIG. 1 shows the deflection yoke apparatus of sadle-sadle type deflection yoke, so called. However, it is apparent that the construction in accordance with the present invention can be applied to a sadletroidal type deflection yoke as well.

According to an aspect of the present invention, there provided a deflection yoke apparatus, which can allocate a component part for compensating a magnetic field characteristic approximately in a predetermined location, even though an external dimension of the component part for compensating a magnetic field characteristic is scattered. Further, the location of the component part for compensating a magnetic field characteristic may not accidentally be shifted. Accordingly, the magnetic field characteristic can be prevented from possible scattering and changes. In addition thereto, location limiting means for limiting a position of a lateral direction of the component part for compensating a magnetic field characteristic is provided, so that the position in the lateral direction is also fixed and scattering of the magnetic field characteristic can be suppressed effectively.

What is claimed is:

1. A deflection yoke apparatus equipped with a container section for containing a component part having a front and a rear end and a top and bottom surface, said component part compensating a magnetic field characteristic of said deflection yoke apparatus, said container section comprising:

a first contacting section for contacting a top surface of the component part;

a second contacting section for contacting said front end of the component part when said component part is inserted into said container section; and a tongue having flexibility for contacting said bottom surface and an edge of said rear end of the component part when said component part is inserted into said container section, said tongue further pressing the component part against both said first and second contacting sections.

2. A deflection yoke apparatus in accordance with claim 1, wherein said tongue is provided with location limiting means for limiting movement of said component part in a lateral direction.

3. A deflection yoke apparatus in accordance with claim 2, wherein said component part has a concave portion and said location limiting means of said tongue is a projection provided on said tongue to cooperate with said concave portion when said component part is inserted and vice-versa.

* * * * *